US011425804B2

(12) United States Patent
Lin et al.

(10) Patent No.: US 11,425,804 B2
(45) Date of Patent: Aug. 23, 2022

(54) COLOR-MIXING LIGHTING CONTROL METHOD AND COLOR-MIXING LIGHTING SYSTEM USING THE SAME

(71) Applicant: ASUSTEK COMPUTER INC., Taipei (TW)

(72) Inventors: Kuo-En Lin, Taipei (TW); Shih-Hung Chou, Taipei (TW); Chih-Yuan Lin, Taipei (TW); Xin-Han Cai, Taipei (TW); I-Ting Hsieh, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 17/324,714

(22) Filed: May 19, 2021

(65) Prior Publication Data

US 2021/0368600 A1 Nov. 25, 2021

(30) Foreign Application Priority Data

May 19, 2020 (TW) ..... 109116493

(51) Int. Cl.
*H05B 45/20* (2020.01)
*H05B 45/46* (2020.01)

(52) U.S. Cl.
CPC ..... *H05B 45/20* (2020.01); *H05B 45/46* (2020.01)

(58) Field of Classification Search
CPC ..... H05B 45/10; H05B 45/20; H05B 45/30; H05B 45/46
See application file for complete search history.

(56) References Cited

U.S. PATENT DOCUMENTS 9,607,577 B2 3/2017 Hajjar
2008/0219303 A1* 9/2008 Chen ..... H04N 9/3129 348/E9.026
2010/0084992 A1* 4/2010 Valois ..... H05B 47/18 315/291

(Continued)

FOREIGN PATENT DOCUMENTS

CN 102298918 A 12/2011
CN 101877208 B 7/2013

(Continued)

*Primary Examiner* — Haissa Philogene
(74) *Attorney, Agent, or Firm* — Muncy, Geissler, Olds & Lowe, P.C.

(57) ABSTRACT

A color-mixing lighting control method is used for receiving an original color-mixing light data to control a color-mixing light source. The color-mixing light source includes a plurality of light-emitting elements to produce a plurality of emission colors. The original color-mixing light data includes a plurality of original light intensity values corresponding to the emission colors. The color-mixing lighting control method comprising: determining a maximum value of the original light intensity values; calculating the light intensity percentage of each of the emission colors in the original color-mixing light data according to the original light intensity values; generating the corrected light intensity value of each of the emission colors according to the maximum value and the light intensity percentage of each of the emission colors; and respectively controlling the light-emitting elements by using the corresponding corrected light intensity value of each of the emission colors.

10 Claims, 2 Drawing Sheets

(56) References Cited

U.S. PATENT DOCUMENTS

| | | | | |
|---|---|---|---|---|
| 2013/0270998 | A1* | 10/2013 | Pi | H05B 45/22 315/51 |
| 2016/0273717 | A1* | 9/2016 | Krames | G02F 1/133603 |
| 2016/0366746 | A1* | 12/2016 | van de Ven | F21K 9/235 |
| 2018/0092179 | A1* | 3/2018 | Guo | H02M 1/14 |

FOREIGN PATENT DOCUMENTS

| | | | |
|---|---|---|---|
| CN | 106851903 | B | 10/2018 |
| TW | I574608 | B | 3/2017 |

* cited by examiner

COLOR-MIXING LIGHTING CONTROL METHOD AND COLOR-MIXING LIGHTING SYSTEM USING THE SAME

CROSS-REFERENCE TO RELATED APPLICATION

This application claims the priority benefit of Taiwan applications serial No. 109116493, filed on May 19, 2020. The entirety of the above-mentioned patent application is hereby incorporated by reference herein and made a part of specification.

BACKGROUND OF THE INVENTION

Field of the Invention

The disclosure relates to light source control method and a light source system and, more particularly, to a color-mixing lighting control method and a color-mixing lighting system.

Description of the Related Art

Generally speaking, LED chips only emits primary colors, such as red, green and blue. White light or other emission color are emitted by a light mixing method.

When the red, green, and blue values are directly output to the LED driver to drive a multi-color LED chip, the following conditions will occur. First of all, the current consumed by color mixing to produce white light is about three times that of monochromatic light, which is very power-consuming. Second, the brightness of multi-color mixing light will be superimposed, which is much different from the brightness of monochromatic light.

BRIEF SUMMARY OF THE INVENTION

A color-mixing lighting control method used for receiving an original color-mixing light data to control a color-mixing light source is provided. The color-mixing light source includes a plurality of light-emitting elements to produce a plurality of emission colors. The original color-mixing light data includes a plurality of original light intensity values corresponding to the emission colors.

The color-mixing lighting control method includes: determining a maximum value of the original light intensity values; calculating the light intensity percentage of each of the emission colors in the original color-mixing light data according to the original light intensity values; generating the corrected light intensity value of each of the emission colors according to the maximum value and the light intensity percentage of each of the emission colors; and respectively controlling the light-emitting elements by using the corresponding corrected light intensity value of each of the emission colors.

A color-mixing lighting system is also provided. The color-mixing lighting system includes a color-mixing light source, a driving unit and a control unit. The color-mixing light source includes a plurality of light-emitting elements to produce a plurality of emission colors.

The control unit is used to: receiving an original color-mixing light data, the original color-mixing light data includes a plurality of original light intensity values corresponding to the emission colors; determining a maximum value of the original light intensity values; calculating the light intensity percentage of each of the emission colors in the original color-mixing light data according to the original light intensity values; and generating the corrected light intensity value of each of the emission colors according to the maximum value and the light intensity percentage of each of the emission colors.

The driving unit is electrically connected with the control unit and the color-mixing light source, for receiving the corrected light intensity value of each of the emission colors, and respectively controlling the light-emitting elements by using the corresponding corrected light intensity value of each of the emission colors.

Through the color-mixing lighting control method and the color-mixing lighting system, before outputting the red, green, and blue values to the LED chip, it can be converted and calculated to maintain the color proportion of the emission colors and make the luminous brightness of the multi-color mixed light consistent with the monochromatic light, to improve the stability of the light, while achieving the effect of power saving.

DETAILED DESCRIPTION OF THE EMBODIMENTS

The embodiments of the present disclosure are disclosed in the following drawings, and for the sake of clarity, the details of the disclosure will be described in the following description. It should be noted that the drawings all adopt a very simplified form and all use imprecise proportions, which are only used to conveniently and clearly assist in explaining the purpose of the embodiments.

Figure 1:
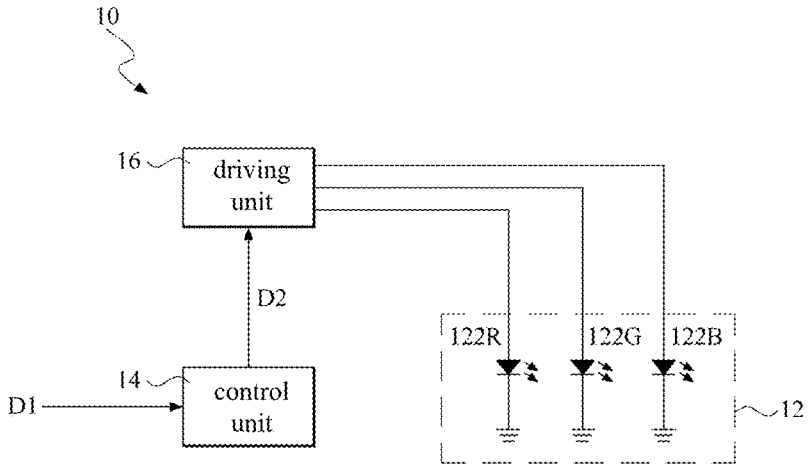
FIG. 1 is a block diagram of a color-mixing lighting system in an embodiment.

FIG. 1 is a block diagram of a color-mixing lighting system in an embodiment. As shown, the color-mixing lighting system 10 includes a color-mixing light source 12, a control unit 14 and a driving unit 16.

The color-mixing light source 12 includes a plurality of light-emitting elements 122R, 122G, 122B to produce a plurality of emission colors. In one embodiment, as shown, the color-mixing light source 12 is a white light source. The color-mixing light source 12 includes a red light-emitting element 122R, a green light-emitting element 122G, and a blue light-emitting element 122B to produce three emission colors of red, green and blue, and the three emission colors is mixed to produce white light, which is not limited herein.

In one embodiment, the color-mixing light source 12 is also a colored light source, such as red and blue the color-mixing light source. In an embodiment, these light-emitting elements 122R, 122G, and 122B are LED chips.

In one embodiment, in addition to the red, green and blue light-emitting elements, the color-mixing light source 12 additionally includes a white light-emitting element to enhance the luminous effect. Furthermore, in one embodiment, the color-mixing light source 12 also includes a plurality of white light emitting elements with different color temperatures, which provide white light illumination with different color temperatures through color mixing.

The control unit 14 is used to receive an original color-mixing light data D1, and generate a corrected color-mixing light data D2 based on the original color-mixing light data D1. The driving unit 16 is electrically connected to the control unit 14 and the color-mixing light source 12 to receive the corrected color-mixing light data D2, and drives the color-mixing light source 12 according to the corrected color-mixing light data D2.

In one embodiment, the driving unit 16 is a multi-channel light emitting diode driving circuit to drive a plurality of the LED chips. The original color-mixing light data D1 includes a plurality of original light intensity values corresponding to a plurality of emission colors that the color-mixing light source 12 can produce. The corrected color-mixing light data D2 includes a plurality of corrected light intensity values corresponding to a plurality of emission colors that the color-mixing light source 12 can produce.

In one embodiment, the control unit 14 is a microcontroller to receive the original color-mixing light data D1 from outside. In one embodiment, the control unit 14 is a processing unit in a microcontroller to receive the original color-mixing light data D1 generated by the microcontroller. The process of converting the original color-mixing light data D1 to the corrected color-mixing light data D2 will be explained in more detail in the subsequent paragraphs.

Figure 2:
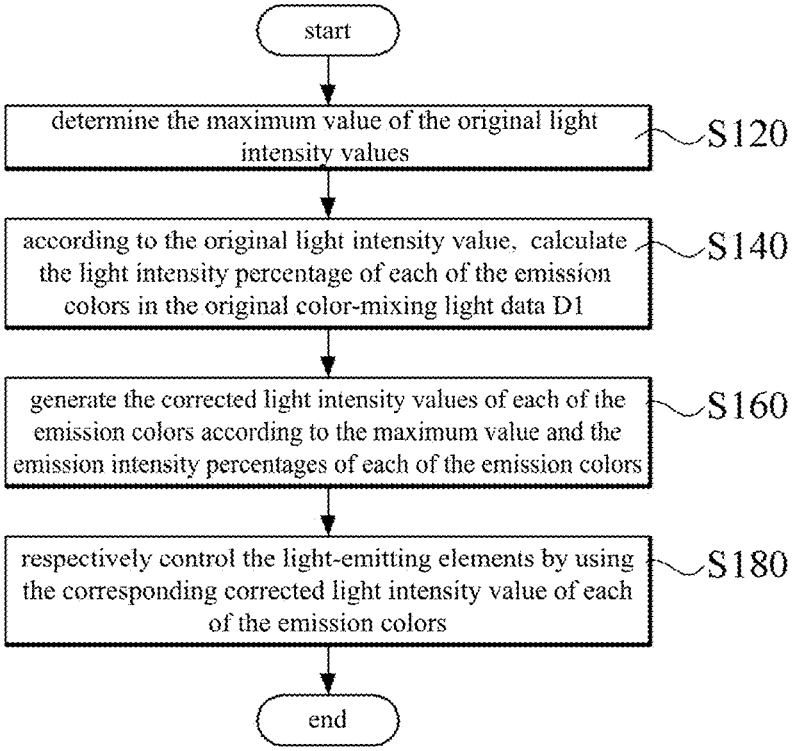
FIG. 2 is a flowchart of a color-mixing lighting control method in an embodiment.

FIG. 2 is a flowchart of a color-mixing lighting control method in an embodiment. The color-mixing lighting control method is executed by the control unit 14 in FIG. 1. The color-mixing lighting control method receives the original color-mixing light data D1 provided from outside to control the color-mixing light source 12 to emit light. The color-mixing light source 12 includes a plurality of light-emitting elements to produce a plurality of emission colors.

In one embodiment, the color-mixing light source 12 is a white light source, which is not limited herein. In one embodiment, the color-mixing light source 12 is also a colored light source. The original color-mixing light data D1 includes a plurality of original light intensity values corresponding to a plurality of emission colors that the color-mixing light source 12 can produce.

First, in step S120, determine the maximum value of the original light intensity values. Next, in step S140, according to the original light intensity value, calculate the light intensity percentage of each of the emission colors in the original color-mixing light data D1.

In one embodiment, this step is to sum all the original light intensity values in the original color-mixing light data D1 to generate a mixing light intensity value, and divides each of the original light intensity values by the mixing light intensity value to generate the light intensity percentage corresponding to each of the emission colors.

Subsequently, in step S160, generate the corrected light intensity values of each of the emission colors according to the maximum value and the light intensity percentages of each of the emission colors. These corrected light intensity values are used to control the corrected color-mixing light data D2 of the color-mixing light source 12.

In one embodiment, in this step, the light intensity percentage corresponding to each of the emission colors is multiplied by the maximum value in the original light intensity value, to generate the corrected light intensity value corresponding to each of the emission colors.

Next, in step S180, respectively control the light-emitting elements by using the corresponding corrected light intensity value of each of the emission colors.

The color-mixing lighting control method will be explained below by using a red, green and blue three-color model. Assuming that the brightness range of the red, green and blue three-color model is 0%-100%, it is defined as follows:

$$X=\{R_o,G_o,B_o\},X\in[0,100]$$

Among them, X is the original light intensity value. The step of the color-mixing lighting control method is summarized as the following correction formula:

$$Y_i = \frac{X_i}{\sum_{n=1}^{3} X_n} \times \max(X),$$

$$i \in [1, 3]$$

Among them, Xi is the original light intensity value of each of the emission colors, and Yi is the corrected light intensity value of each of the emission colors.

Through the color-mixing lighting control method provided, the light intensity of red, green and blue is effectively controlled within a certain range (that is, the maximum value of monochromatic lighting). In this way, the driving current and brightness of the color-mixing light source is controlled to maintain stability when single-color, two-color or three-color light is emitted, avoiding the flickering and dimming state.

For example, suppose the original light intensity value of the red, green and blue model is X (75%, 75%, 0%). If directly use this value to drive the color-mixing light source, its overall brightness value will reach 75%+75%+0=150%. Through the correction conversion of the color-mixing lighting control method, based on that the maximum value X(max) in the original light intensity values is 75% and the proportion of each of the emission colors in the original color-mixing light data D1 is (0.5, 0.5, 0), the corrected light intensity value is calculated as Y (37.5%, 37.5%, 0.0%), and the overall brightness value is controlled at 37.5%+37.5%+0=75%.

Through the color-mixing lighting control method and the color-mixing lighting system, before outputting the red, green, and blue values to the LED chip, it can be converted and calculated to maintain the color proportion of the emission colors and make the luminous brightness of the multi-color mixed light consistent with the monochromatic light, to improve the stability of the light, while achieving the effect of power saving.

Although the present disclosure has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. A color-mixing lighting control method, for receiving an original color-mixing light data to control a color-mixing light source, wherein the color-mixing light source includes a plurality of light-emitting elements to produce a plurality of emission colors, wherein the original color-mixing light data includes a plurality of original light intensity values corresponding to the emission colors, and the color-mixing lighting control method comprising:

determining a maximum value of the original light intensity values;

calculating a light intensity percentage of each of the emission colors in the original color-mixing light data according to the original light intensity values;

generating a corrected light intensity value of each of the emission colors according to the maximum value and the light intensity percentage of each of the emission colors; and respectively controlling the light-emitting elements by using the corresponding corrected light intensity value of each of the emission colors.

2. The color-mixing lighting control method according to claim 1, wherein, the color-mixing light source is a white light source.

3. The color-mixing lighting control method according to claim 1, wherein, the emission colors include red, green and blue.

4. The color-mixing lighting control method according to claim 1, wherein, the light-emitting elements are LED chips.

5. The color-mixing lighting control method according to claim 1, wherein, the step of calculating the light intensity percentage of each of the emission colors in the original color-mixing light data according to the original light intensity values comprises:

summing the original light intensity values to generate a mixing light intensity value; and dividing each of the original light intensity value by the mixing light intensity value to generate the light intensity percentage corresponding to each of the emission colors.

6. The color-mixing lighting control method according to claim 1, wherein, the step of generating the corrected light intensity value of each of the emission colors according to the maximum value and the light intensity percentage of each of the emission colors is multiplying the light intensity percentage corresponding to each of the emission colors by the maximum value in the original light intensity values to generate the corrected light intensity value corresponding to each of the emission colors.

7. A color-mixing lighting system, comprising:

a color-mixing light source, including a plurality of light-emitting elements to produce a plurality of emission colors;

a control unit, configured:

receive an original color-mixing light data, wherein the original color-mixing light data includes a plurality of original light intensity values corresponding to the emission colors;

determine a maximum value of the original light intensity values;

calculating a light intensity percentage of each of the emission colors in the original color-mixing light data according to the original light intensity values; and generate a corrected light intensity value of each of the emission colors according to the maximum value and the light intensity percentage of each of the emission colors;

a driving unit, electrically connected with the control unit and the color-mixing light source, for receiving the corrected light intensity value of each of the emission colors, and respectively controlling the light-emitting elements by using the corresponding corrected light intensity value of each of the emission colors.

8. The color-mixing lighting system according to claim 7, wherein, the color-mixing light source is a white light source.

9. The color-mixing lighting system according to claim 7, wherein, the emission colors include red, green and blue.

10. The color-mixing lighting system according to claim 7, wherein, the light-emitting elements are LED chips.

* * * * *